US007568968B2

(12) United States Patent
Pilkington

(10) Patent No.: US 7,568,968 B2
(45) Date of Patent: Aug. 4, 2009

(54) COOLANT NOZZLE POSITIONING FOR MACHINING WORK-PIECES

(75) Inventor: Mark Iain Pilkington, Camby, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 11/839,743

(22) Filed: Aug. 16, 2007

(65) Prior Publication Data

US 2009/0047875 A1 Feb. 19, 2009

(51) Int. Cl.
*B24B 49/00* (2006.01)

(52) U.S. Cl. ..... 451/7; 451/53; 451/54; 451/449

(58) Field of Classification Search ..... 451/7, 451/9, 10, 11, 53, 54, 449, 450, 488
See application file for complete search history.

(56) References Cited

U.S. PATENT DOCUMENTS

| | | | | |
|---|---|---|---|---|
| 3,978,625 | A | 9/1976 | Klaassen | |
| 4,671,708 | A | 6/1987 | Hurd | |
| 4,830,553 | A | 5/1989 | Abeyta et al. | |
| 4,991,358 | A | 2/1991 | Giebmanns | |
| 5,111,625 | A | 5/1992 | Simpfendorfer et al. | |
| 5,961,376 | A | 10/1999 | Gottschald | |
| 6,123,606 | A | 9/2000 | Hill et al. | |
| 6,454,636 | B1 * | 9/2002 | Iwabuchi | 451/53 |
| 6,666,748 | B2 | 12/2003 | Hiramoto et al. | |
| 6,932,673 | B2 | 8/2005 | Morita et al. | |
| 7,021,994 | B2 | 4/2006 | Ahti et al. | |
| 7,153,187 | B2 | 12/2006 | Ahti et al. | |
| 2004/0072521 | A1 * | 4/2004 | Pflager et al. | 451/415 |
| 2006/0068683 | A1 | 3/2006 | Sudo | |
| 2006/0246823 | A1 * | 11/2006 | Morita et al. | 451/7 |
| 2008/0219781 | A1 * | 9/2008 | Hyatt et al. | 407/11 |

* cited by examiner

*Primary Examiner*—Eileen P. Morgan
(74) *Attorney, Agent, or Firm*—MacMillan, Sobanski & Todd, LLC

(57) ABSTRACT

A method of determining a position of a coolant nozzle relative to a rotating grinding wheel removing material from a work-piece and an apparatus for practicing the method are disclosed. The method includes the step of disposing a coolant nozzle having a base and a distal end for adjustable movement relative to the grinding wheel and the work-piece. The distal end of the coolant nozzle can be moved in a first plane normal to an axis of the grinding wheel along a first arcuate path centered on a pivot axis at the base. The distal end can also be moved by moving the pivot axis in the first plane along an orbit centered on the grinding wheel axis. The method also includes the step of selecting a position of the distal end along the first arcuate path. The method also includes the step of projecting a second arcuate path in the first plane centered on the grinding wheel axis and having a radius extending to the position of the distal end along the first arcuate path. The method also includes the step of generating a third arcuate path in the first plane corresponding to a location of the work-piece that would be contacted first by the distal end during movement along the second arcuate path. The method also includes the step of limiting movement of the distal end along the second arcuate path by an intersection between the second arcuate path and the third arcuate path.

19 Claims, 10 Drawing Sheets

COOLANT NOZZLE POSITIONING FOR MACHINING WORK-PIECES

BACKGROUND OF THE INVENTION

1. Field of the Invention

This invention relates to metal working generally and more particularly to metal working with a rotating or oscillating fluid applicator.

2. Description of Related Prior Art

It can be desirable to direct cooling fluid at a grinding wheel during a grinding operation. Fluid can cool the grinding wheel and thereby increase the work life of the grinding wheel. The cooling fluid can be dispensed by a coolant nozzle that is moveable relative to the grinding wheel. One known apparatus for supply cooling fluid to a cutting tool is described in U.S. Pat. No. 4,392,761 to Eckle. The rotary machinery tool described in the Eckle patent includes a coolant delivery system wherein coolant is supplied during the cutting operation from a supply pipe through a series of bores to the cutting members or plates. The coolant is supplied during the cutting operation. U.S. Pat. No. 6,123,606 also relates to coolant nozzle positioning.

SUMMARY OF THE INVENTION

In summary, the invention is a method of determining a position of a coolant nozzle relative to a rotating grinding wheel removing material from a work-piece and an apparatus for practicing the method. The method includes the step of disposing a coolant nozzle having a base and a distal end for adjustable movement relative to the grinding wheel and the work-piece. The distal end of the coolant nozzle can be moved in a first plane normal to an axis of the grinding wheel along a first arcuate path centered on a pivot axis at the base. The distal end can also be moved by moving the pivot axis in the first plane along an orbit centered on the grinding wheel axis. The method also includes the step of selecting a position of the distal end along the first arcuate path. The method also includes the step of projecting a second arcuate path in the first plane centered on the grinding wheel axis and having a radius extending to the position of the distal end along the first arcuate path. The method also includes the step of generating a third arcuate path in the first plane corresponding to a location of the work-piece that would be contacted first by the distal end during movement along the second arcuate path. The method also includes the step of limiting movement of the distal end along the second arcuate path by an intersection between the second arcuate path and the third arcuate path.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EXEMPLARY EMBODIMENT

Figure 1:
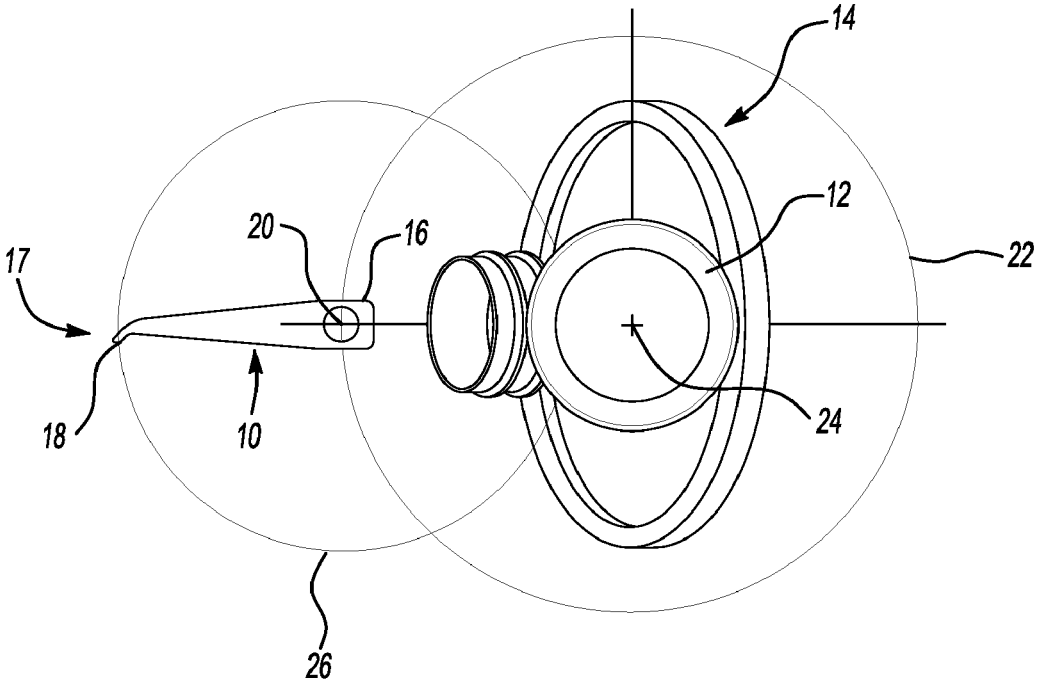
FIG. 1 is a perspective view of a work-piece, a grinding wheel, and a coolant nozzle wherein a grinding wheel axis of the grinding wheel and a pivoting axis of the coolant nozzle are normal to the plane of perspective.
Figure 2:
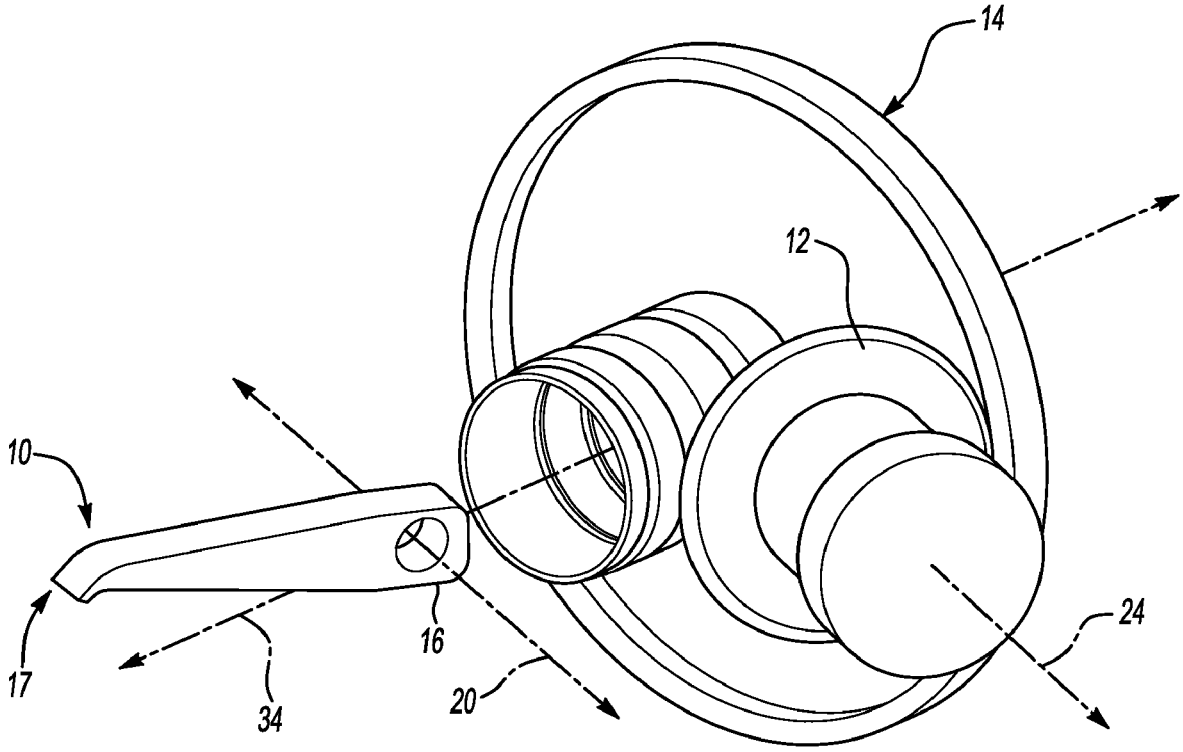
FIG. 2 is a second perspective view of the structures shown in FIG. 1.

A plurality of different embodiments of the invention are shown in the Figures of the application. Similar features are shown in the various embodiments of the invention. Similar features have been numbered with a common reference numeral and have been differentiated by an alphabetic designation. Also, to enhance consistency, features in any particular drawing share the same alphabetic designation even if the feature is shown in less than all embodiments. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

The present invention provides an apparatus for performing a grinding operation on a work-piece. The apparatus includes a moveable coolant nozzle and the invention also provides a method that can be performed by the apparatus for positioning the moveable coolant nozzle. The method according to the invention, as will be shown by the exemplary embodiments set forth below, can precisely position the nozzle in view of the known geometry of the grinding wheel and the work-piece, as well as the positions of the grinding wheel and the work-piece relative to one another. The method can convert three-dimensional data into planar (two-dimensional) data for machine code. Data is manipulated back-and-forth across two planes to enhance the precision with which the coolant nozzle can be positioned. As a result of the enhanced precision in positioning the coolant nozzle, the grinding operation can be carried out more aggressively without compromising tool life. Furthermore, the method according to the invention can be applied to move the coolant nozzle during the grinding operation in response to changes in the size of the grinding wheel.

Figure 3:
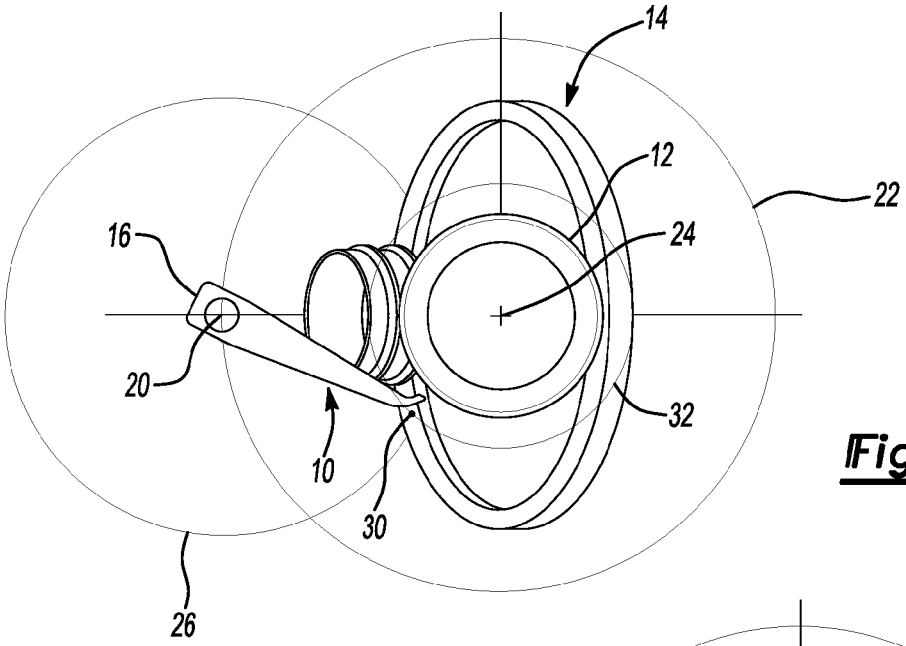
FIG. 3 is a third perspective view of the structures shown in FIG. 1, shares the same plane of perspective as FIG. 1, and shows the coolant nozzle rotated or pivoted about the pivoting axis.
Figure 4:
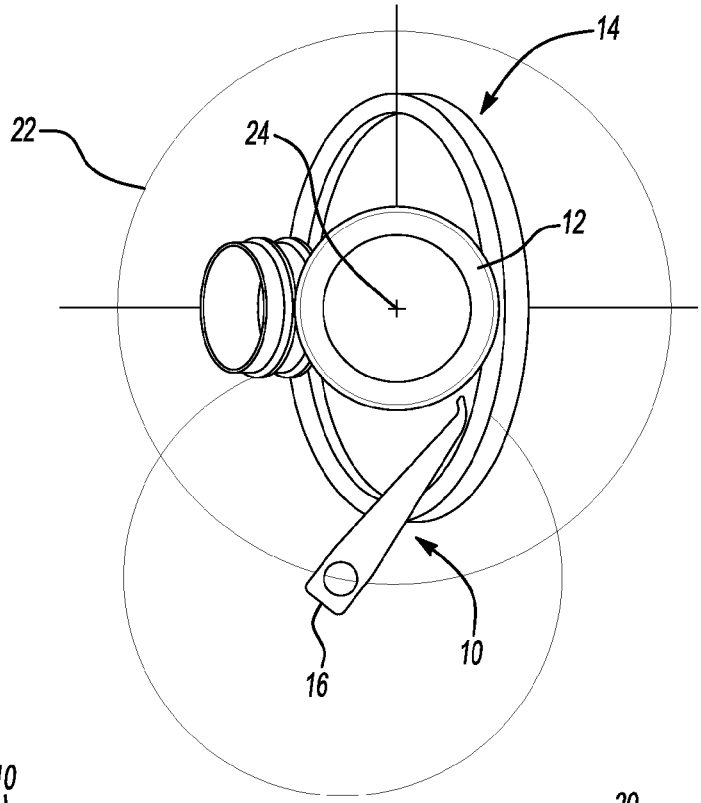
FIG. 4 is a fourth perspective view of the structures shown in FIG. 1, shares the same plane of perspective as FIG. 1, and shows the pivoting axis moved along an orbit about the grinding wheel axis.
Figure 5:
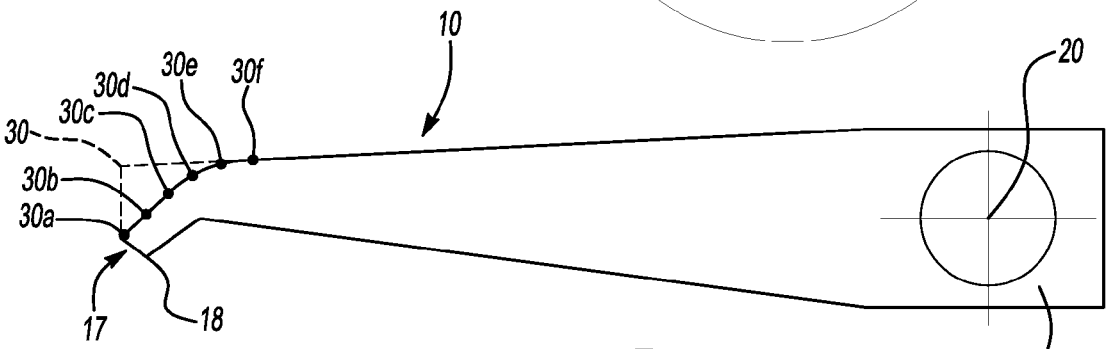
FIG. 5 is a front view of the coolant nozzle.
Figure 6:
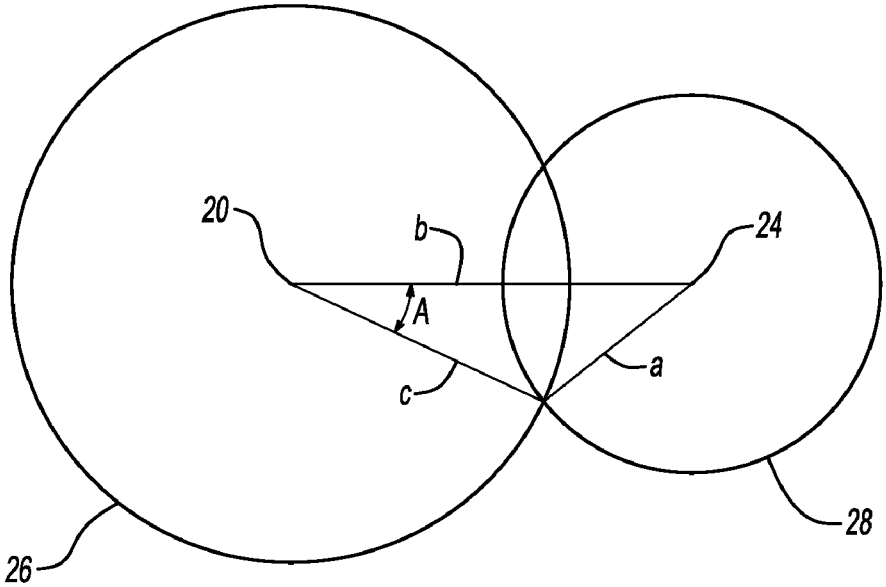
FIG. 6 is a schematic view showing a safety diameter associated with the grinding wheel and a first arcuate path of a distal end of the coolant nozzle centered on the pivoting axis.

Referring now to FIGS. 1, 3 and 4, the exemplary embodiment of the present invention provides a method for positioning a coolant nozzle 10 relative to a grinding wheel 12, for applying coolant to the grinding wheel 12 as the grinding wheel 12 is removing metal from a work-piece 14. The invention also provides an apparatus for practicing the exemplary method. The coolant nozzle 10 extends from a base 16 to a distal end 17. The distal end 17 can be rotated about a pivot axis 20 adjacent to the base 16. FIG. 1 shows the coolant nozzle 10 at a "home" position and FIG. 3 shows the distal end 17 rotated away from the home position about the pivot axis 20 to an exemplary "working" position. In addition to rotation about the pivot axis 20, the position of the coolant nozzle 10 relative to the grinding wheel 12 can also be adjusted by moving the pivot axis 20 of the coolant nozzle 10 along an orbit 22. The orbit 22 is centered on an axis 24 of rotation of the grinding wheel 12. FIG. 1 is a view of a first plane that is normal to the grinding wheel axis 24. FIG. 1 shows the coolant nozzle 10 at the home position and FIG. 4 shows the coolant nozzle 10 rotated about the pivot axis 20 and also shows the pivot axis 20 moved along the orbit 22.

Referring now to FIGS. 1-3 and 5-7, the exemplary distal end 17 includes an inner tip 18 and an outer end control point 30. The tip 18 is a real or "hard" point in the exemplary embodiment of the invention and is the point on the nozzle 10 that will be closest to the grinding wheel 12 during the grinding operation. The outer end control point 30 is an imaginary or "soft" point in the exemplary embodiment of the invention and represents the point that might contact the work-piece 14 during the grinding operation. The exemplary method is performed as if the point 30 was real and is performed to prevent the point 30 from contacting the work-piece 14.

Figure 7:
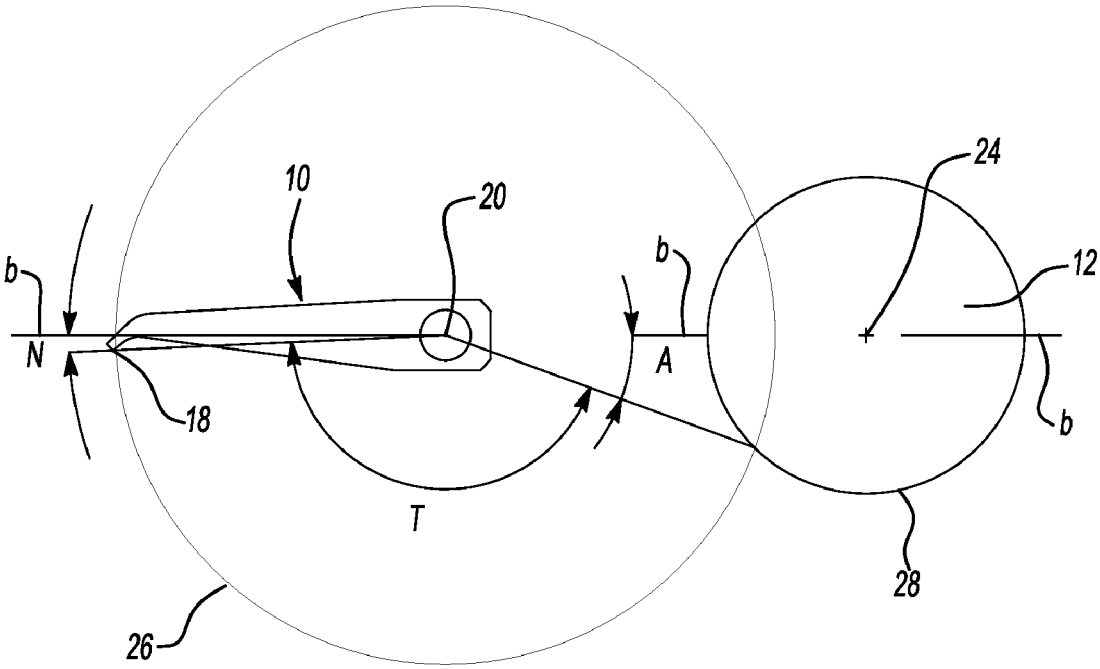
FIG. 7 is a second schematic view similar to FIG. 6 in which the coolant nozzle has been added.

The preferred angle of rotation of the distal end 17 about the pivot axis 20 can be determined by first plotting a first arcuate path of movement. In the first exemplary embodiment of the invention, the first arcuate path is a circle 26 centered on the pivot axis 20. Alternative arcuate paths may not be full circles. The radius of the circle 26 is represented by the line designated by the letter "c" in FIG. 6 and extends from the pivot axis 20 to the nozzle tip 18. A circle 28 can also be plotted about the grinding wheel axis 24. The circle 28 has a radius represented by the line designated by the letter "a"; the length of the line is equal to the combination of the radius of the grinding wheel 12 and any desired clearance between the nozzle tip 18 and the grinding wheel 12. An axis represented by the line designated by the letter "b" extends between the axes 20, 24. The circles 26, 28 intersect one another at a point along the circle 26 that is spaced from the axis b at an angle represented by the letter "A". The angle A is equal to the inverse cosine of $((b^2+c^2-a^2)/2bc)$. Thus, in the first exemplary embodiment of the invention, the point of intersection of the circles 26, 28 can be selected as the working position of the tip 18 and distal end 17 along the circle 26. FIG. 7 shows the nozzle tip 18 of the first exemplary embodiment of the invention at the home position. The tip 18 is spaced from the axis b an angle "N". Therefore, the tip 18 is rotated about the pivot axis 20 an angle "T" to reach the working position, where T is equal to 180°−A−N.

The position of the nozzle 10 can also be adjusted relative to the grinding wheel 12 by moving the pivot axis 20 along the orbit 22 after the angle T has been determined. The extent of movement of the pivot axis 20 along the orbit 22 is limited by the geometry of the work-piece 14 being ground. It is generally undesirable to move the pivot axis 20 along the orbit 22 such that the coolant nozzle 10 strikes or collides with the work-piece 14.

In determining the angle "T" above, the tip 18 was considered as the point of reference for the nozzle 10. When determining the extent of movement of the axis 20 along the orbit 22, the outer end control point 30 of the distal end 17 is considered. The end control point 30 can be viewed as an envelope dimension, or a radially outer-most dimension of the nozzle 10. The tip 18 is considered when positioning the distal end 17 relative to the grinding wheel 12 and the end control point 30 is considered when positioning the distal end 17 relative to the work-piece 14. The first exemplary embodiment of the invention can determine a preferred position of the pivot axis 22 along the orbit 22 by determining how close the end control point 30 can be positioned relative to the work-piece 14 without contacting the work-piece 14.

In a first step for determining the position of the pivot axis 20 along the orbit 22, a circle 32 (shown in FIG. 3) is projected or plotted in the first plane about the grinding wheel axis 24. The circle 32 is an exemplary second arcuate path and is defined by a radius extending between the axis 24 and the end control point 30 when the tip 18 is in the working position. In other words, the radius of the circle 32 is based at least in part on the position of the tip 18 along the first arcuate path. The position of the tip 18 is determined first in the first exemplary embodiment of the invention. The circle 26 can be viewed as representing an "inner" boundary of interference for the coolant nozzle 10. The circle 26 is associated with the potential for interference between the coolant nozzle 10 and the grinding wheel 12. The circle 32 can be viewed as representing an "outer" boundary of interference for the coolant nozzle 10. The circle 32 is associated with the potential for interference between the coolant nozzle 10 and the work-piece 14.

Figure 8:
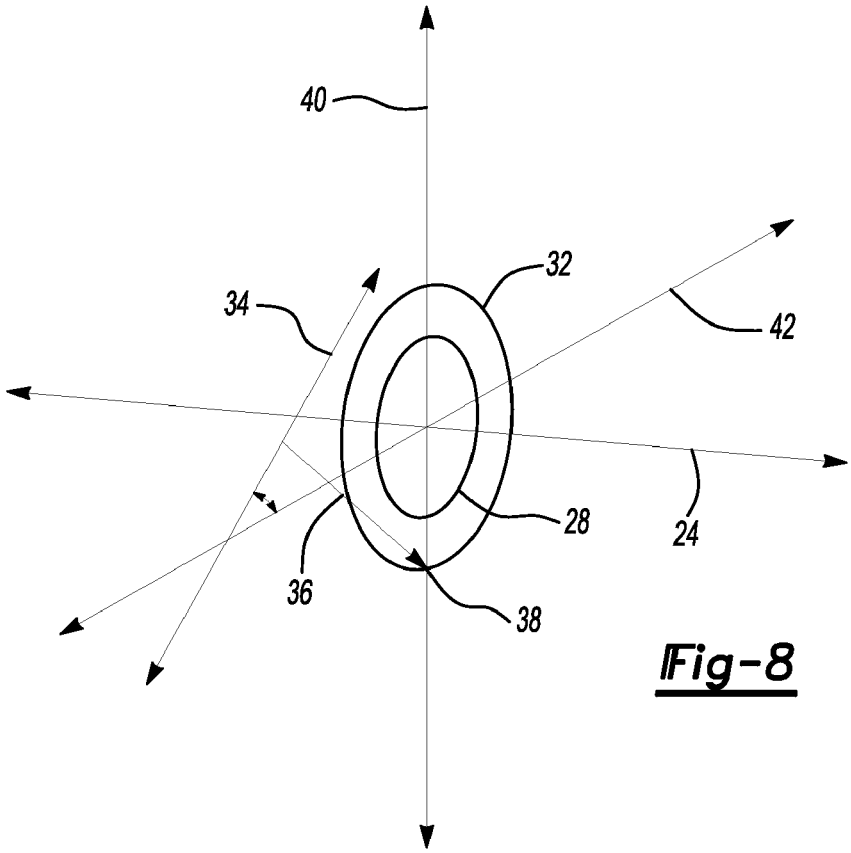
FIG. 8 is a view of a three-dimensional coordinate system containing the grinding wheel axis, the longitudinal axis of the work-piece, the safety diameter of the grinding wheel, and a second arcuate path of movement of the outer end control point of the coolant nozzle.

In the exemplary operating environment, the axis 24 of rotation of the grinding wheel 12 and a longitudinal axis 34 of the work-piece are transverse to one another. Also, the circle 32 is defined in the first plane and the first plane is transverse to a plane containing both the grinding wheel axis 24 and a longitudinal axis 34 of the work-piece, hereafter referred to as the "working" or second plane. More specifically, the first plane is perpendicular to the working/second plane. FIG. 8 shows the axis 24, 34 and circle 32 in perspective view to illustrate the spatial relationships between these elements. In alternative operating environments, the plane of the circle 32 may not be perpendicular to the working plane, but may still be transverse to the working plane. In still other operating environments, the circle 32 may be contained in the working plane. For operating environments in which the circle 32 is not contained in the working plane, the exemplary embodiment of the invention provides a method for converting the circle 32 into a two-dimensional curve in the working plane.

Figure 9:
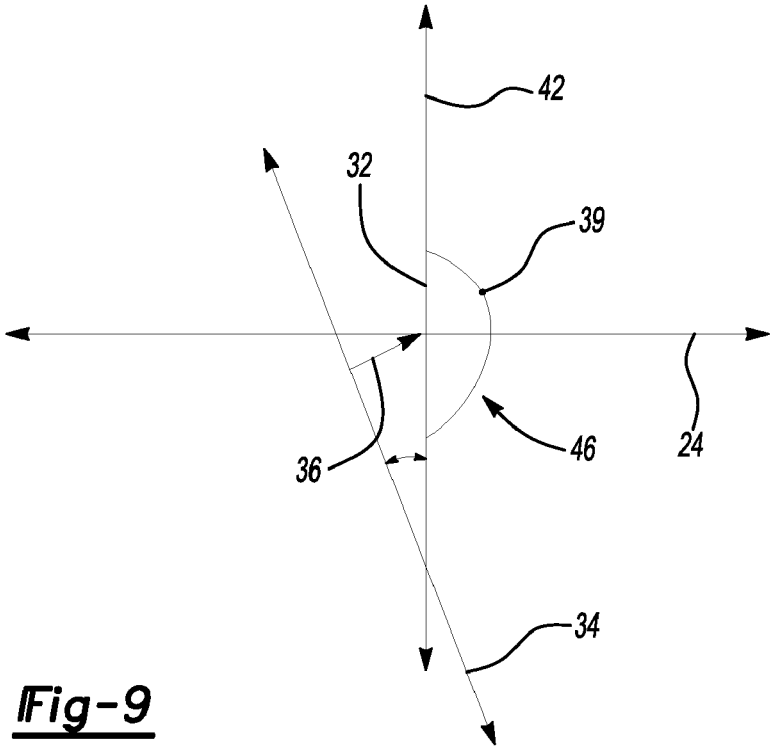
FIG. 9 is a planar view corresponding to the three-dimensional view of FIG. 8 wherein the plane is a working plane, containing the grinding wheel axis and the longitudinal axis of the work-piece.
Figure 10:
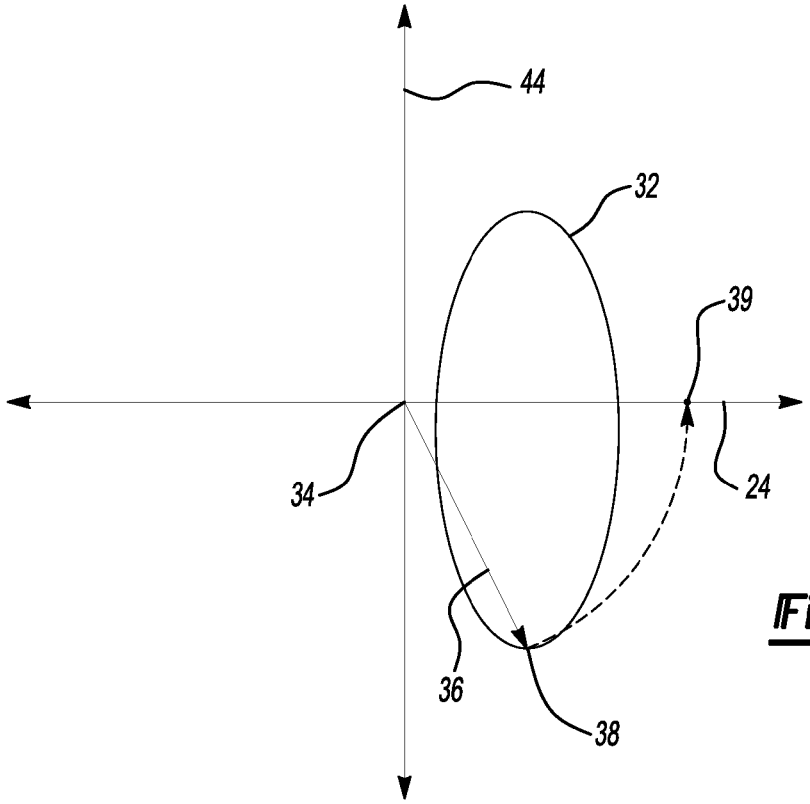
FIG. 10 is a planar view corresponding to the three-dimensional view of FIG. 9, wherein the plane is normal to the longitudinal axis of the work-piece.

In a second step for determining the position of the distal end 17 along the circle 32 (and thus the position of the pivot axis 20 along the orbit 22), the circle 32 is converted into a two-dimensional curve in the working plane. Each point of the circle 32 can be "moved" into the working plane. For each point, a vector is extended from, and normal to, the longitudinal axis 34 to the individual point. In FIG. 8, a vector 36 extends to a point 38 of the circle 32. FIGS. 9 and 10 show planar views of the elements shown in the perspective view of FIG. 8. FIG. 8 includes two reference axes 40 and 42; the axes 24, 40, and 42 are perpendicular to one another to define three-dimensional space. The point 38 of the circle 32 is moved or converted into a second point 39 the working plane by rotating the origin of the vector 36 about the longitudinal axis 34. The second point 39 is thus generated by the rotation of the vector 36. FIG. 10 shows a dashed line to represent the movement or conversion of the point 38 into point 39 in the working plane. A reference axis 44 in FIG. 10 is perpendicular to the axes 24, 34 and is parallel to the axis 40 shown in FIG. 8. FIG. 9 shows the position of the point 39 in the working plane.

Figure 13:
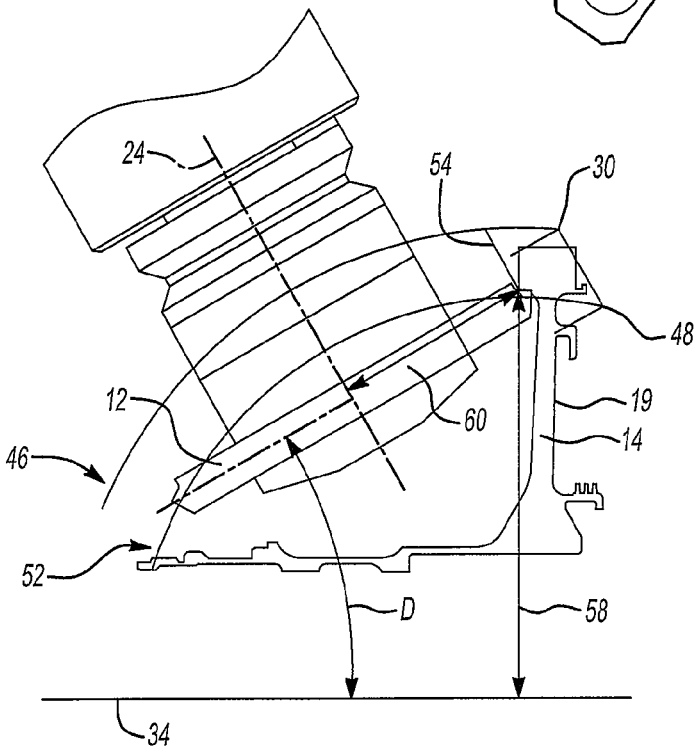
FIG. 13 is a planar view of the working plane showing a pair of curves useful for determining a point of contact between a coolant nozzle and a work-piece.

After all of the points of the circle 32 have been so moved, a curve 46 will be generated in the working plane. As best shown in FIG. 13, an outer profile 19 of the work-piece 14 is also projected or plotted in the second plane. The outer profile 19 can be determined based on the geometry of the work-piece 14 defined in computer-aided design file. The exemplary curve 46 intersects the outer profile 19 and, as will be set forth below, that point of intersection can be used to generate a third arcuate path in the first plane. The third arcuate path represents the perimeter of the work-piece 14 that would first contact the end control point 20, as that perimeter appears in the first plane. FIGS. 11*a*-11*d* show alternative operating environments with alternative curves 46*a*-46*d*.

Figure 12:
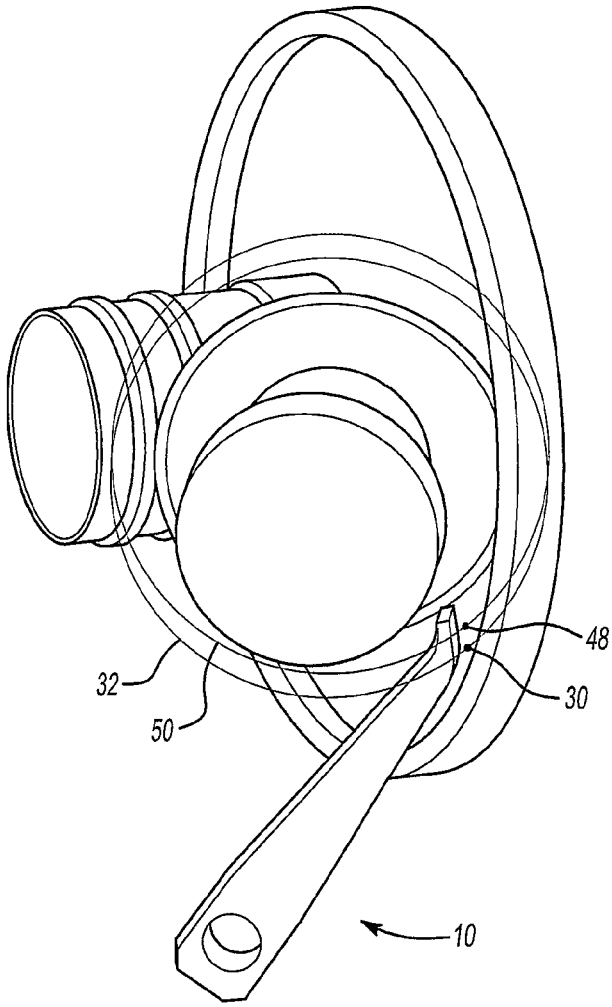
FIG. 12 is a perspective view corresponding to FIG. 4 wherein the distal end of the coolant nozzle has been rotated about the pivot axis and also the pivoting axis has been moved about the orbit.

The curve 46 was generated based on a single end control point 30. Because the coolant nozzle 10 has a depth and is therefore three-dimensional, it can be desirable to generate a pair of curves in the working plane, one each for a "front" end control point and one for a "rear" end control point. FIG. 12 shows the end control point 30 as the front point and a second end control point 48 as the rear point. A circle 50 is associated with the rear end control point 48 as the circle 32 is associated with the front end control point 30. The circle 50 can be viewed as a fourth arcuate path, defined in a third plane that is parallel to the first plane.

In alternative embodiments of the invention, a plurality of curves can be generated in the second plane based on a plurality of concentric arcuate paths defined in the first plane. A plurality of points 30*a*-30*f* are identified in FIG. 5. The points 30*a*-30*f* could be used individually, collectively, in conjunction with the point 30, in the place of point 30, or any combination thereof, to generate one or more arcuate paths that are converted into curves in the second plane.

FIG. 13 shows the curve 46, corresponding to the circle 32 and the end control point 30, and a similarly constructed curve 52 that corresponds to the circle 50 and the end control point 48. The perspective of the view of FIG. 13 is from a bottom, looking-up orientation; FIG. 9, on the other hand, is a top, looking-down perspective. The curves 46, 52 are useful in determining the location on the work-piece 14 that the coolant nozzle 10 will first contact if the pivot axis 20 is moved too far along the orbit 22.

Figure 14:
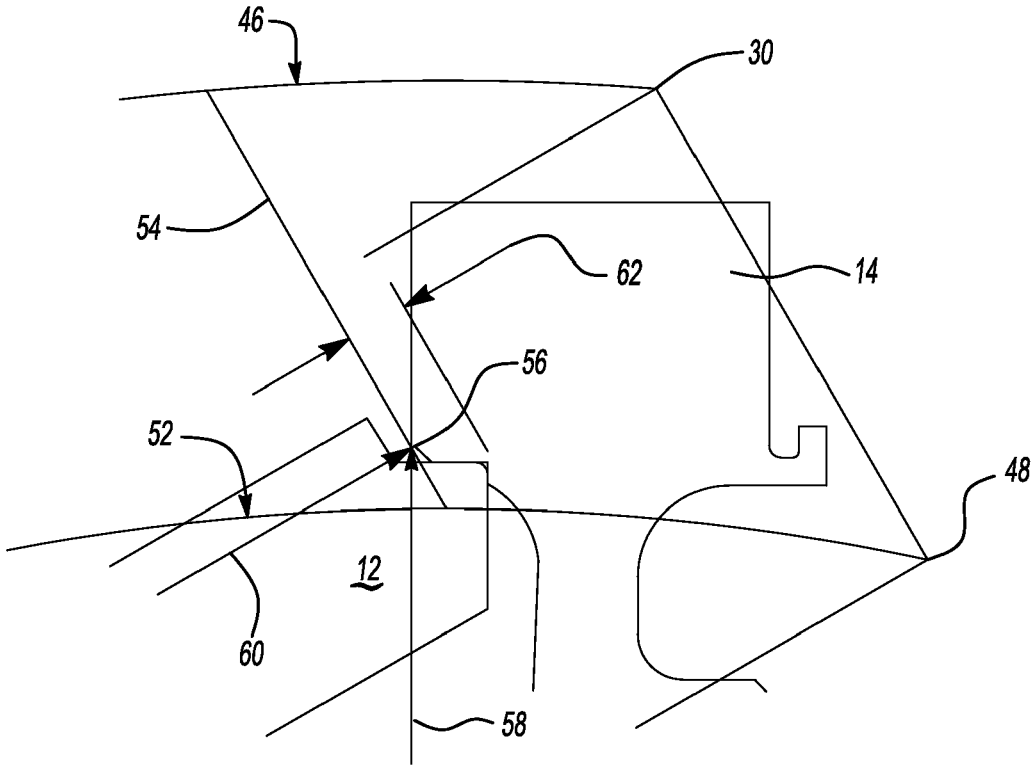
FIG. 14 is a magnified view of FIG. 13 showing the general point of contact between the coolant nozzle and the work-piece.

A line 54 can be extended between the curves 46, 52. The line 54 is parallel to the axis 24 and represents the nozzle 10. The line 54 can be moved radially outward from the axis 24, toward the work-piece and remaining parallel to the axis 24, until just prior to the line 54 contacting the work-piece 14. FIG. 13 shows the position of the line 54 just prior to contact and FIG. 14 is a magnified view of the line 54 at the position substantially immediately prior to contact. FIGS. 13 and 14 show that a point 56 on the work-piece 14 would be the first point of contact between the work-piece 14 and the coolant nozzle 10. In the exemplary embodiment of the invention, the point 56 is spaced a distance from the longitudinal axis 34 of the work-piece 14, represented by line segment 58. The line segment 58 is normal to the longitudinal axis 34. The point 56 is also spaced a distance from the grinding wheel axis 24, represented by line segment 60. The line segment 60 is normal to the grinding wheel axis 24. The point 56 is also offset from the outside diameter of the grinding wheel 12, a distance represented by the reference numeral 62. An alternative way to determine the distances represented by 58 and 60 and 62 would be using a 3D CAD system. These dimensions are useful generating the third arcuate path in the first plane, as set forth below.

All of the steps described above can be performed "off-line". These steps can be performed and calculations can be made without a cutting machine and/or without cutting the work-piece. In the exemplary embodiment of the invention, the steps set forth below are performed at run time and are executed in the cutting machine controller due to the fact that the size of the grinding wheel 12 is not known until run time.

Figure 16:
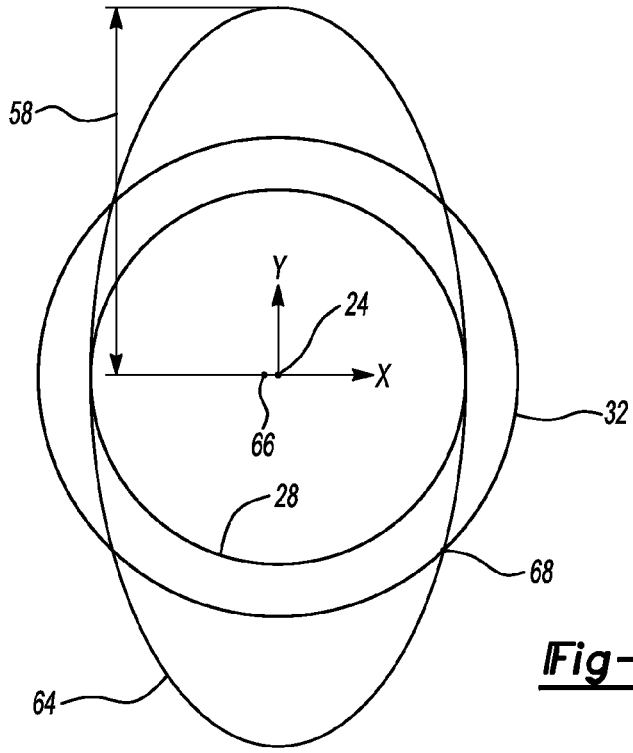
FIG. 16 is a planar view similar to FIGS. 1, 3 and 4 wherein the grinding wheel axis is normal to the plane of perspective and shows an ellipse generated from a circle in the working plane.

The dimensions set forth above, as well as the angle "D" between the grinding wheel 12 and the longitudinal axis 34 can be used to create the third arcuate path. In the exemplary embodiment of the invention, the third arcuate path is an ellipse 64, as best shown in FIG. 16. The ellipse 64 is disposed in the first plane. The ellipse 64 is defined by the following equation:

$$[(x-h)^2/e^2]+[(y-k)^2/f^2]=1$$

Figure 15:
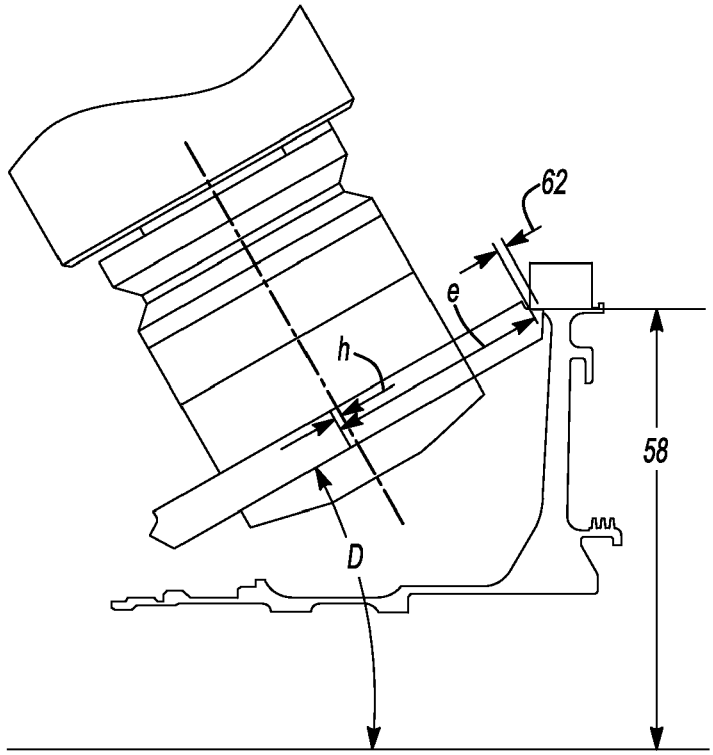
FIG. 15 is a planar view of the working plane showing the dimensions useful for creating an ellipse in the plane normal to the grinding wheel axis.

In the equation for the ellipse 64, the letter "f" is the distance from the center of the ellipse 64 to the maximum height of the ellipse 64. In the exemplary embodiment of the invention, the distance f is equal to the length of the line segment 58. The letter "k" is the y-coordinate of the center of the ellipse 64. In the exemplary embodiment of the invention, k equals 0. The circle that would be defined by sweeping the line segment 58 about the longitudinal axis 34 is centered in the working plane. Therefore, the center of the ellipse 64 will not be offset in the y direction from the grinding wheel axis 24. The values for the letters "h" and "e" can be determined by using trigometric functions. The letter "h" is the x coordinate of the center of the ellipse 64. The letter "e" is the distance from the center of the ellipse 64 to a maximum width of the ellipse 64. The letter "e" is equal to the length of the line segment 58 multiplied by the value for the sine function of the angle D. The value for the letter "h" is equal to a radius of the grinding wheel less the value of "e" and less the distance 62 of the radial offset between a radius of the grinding wheel 12 and the point 56. For a continuous-dress grinding cycle in which diameter of the grinding wheel 12 decreases during the machining, the value for letter "h" would be the radius of the grinding wheel at the end of the cut rather than the start as the wheel 12 will be smaller, requiring a more restrictive position of the nozzle 10. FIG. 15 shows the dimensions of the ellipse 64 as they appear in the working plane.

FIG. 16 shows the ellipse 64, having a center point 66, in the first plane, which is normal to the grinding wheel axis 24. FIG. 16 also shows the circles 28 and 32. To determine the appropriate position for the end control point 30 along the circle 32, the equation of the circle 32 and the equation for the ellipse 64 are solved simultaneously for the x value and y value of the intersection point 68. The equation of a circle is:

$$(x-h)^2+(y-k)^2=r^2$$

In the equation for the circle, the values for h and k can be set at 0. The value for r is the radius of the circle 32. Since the geometry of the nozzle 10 and the relative positions of the grinding wheel axis 24 and the pivot axis 20 are known, the radius r of the circle 32 is known. When the appropriate position for the end control point 30 along the circle 32 is known, the position of the pivot axis 20 along the orbit 22 will necessarily follow. Thus, the exemplary embodiment of the invention has provided a method for determining the angle to rotate the distal end 17 about the pivot axis 20 and also the extent of movement of the pivot axis 20 along the orbit 22.

Figure 17:
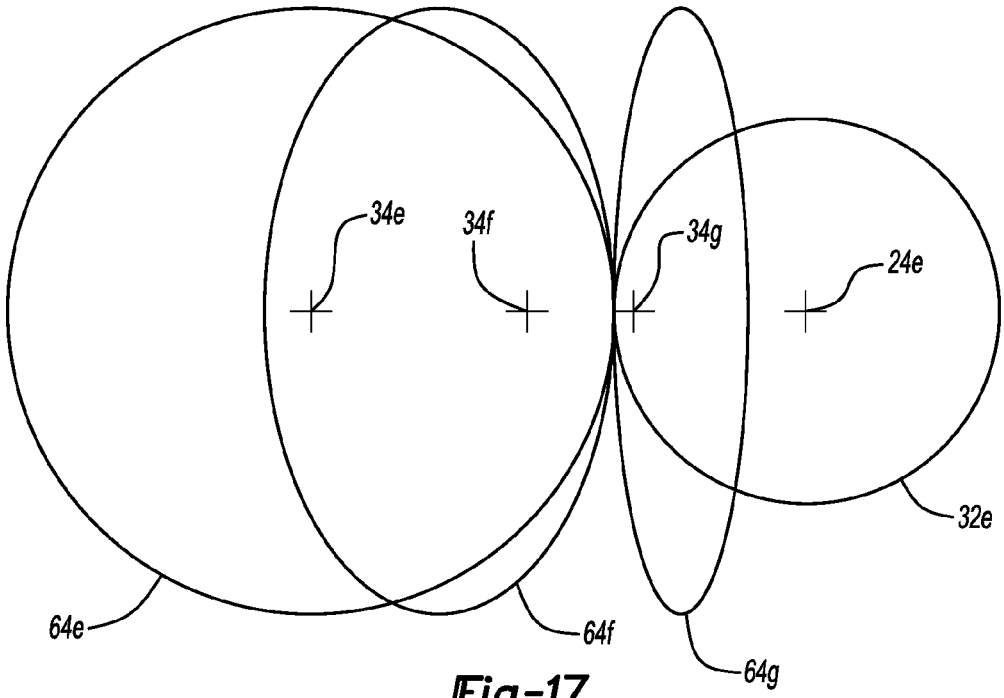
FIG. 17 is a planar view similar to FIGS. 1, 3 and 4 wherein the grinding wheel axis is normal to the plane of perspective and shows a plurality of ellipses corresponding to alternative operating environments for practicing the invention.

FIG. 17 shows three possible alternative operating environments different than the exemplary embodiment discussed in detail above. A grinding wheel axis 24*e* is surrounded by a circle 32*e*. The circle 64*e* represents a work-piece to be machined wherein the grinding wheel axis 24*e* and the longitudinal axis 34*e* are parallel to one another and the outside diameter of the work-piece is cylindrical. The ellipse 64*f* represents a work-piece to be machined wherein the grinding wheel axis 24*e* and the longitudinal axis 34*f* of the work-piece are at an angle to one another and an outer surface of the work-piece is being machined. The ellipse 64*g* is similar to the ellipse 64 in that the ellipse 64*g* represents a work-piece that is being machined on an inner surface. Also, the grinding wheel axis 24*e* and the longitudinal axis 34*g* are non-parallel to one another.

Figure 11A:
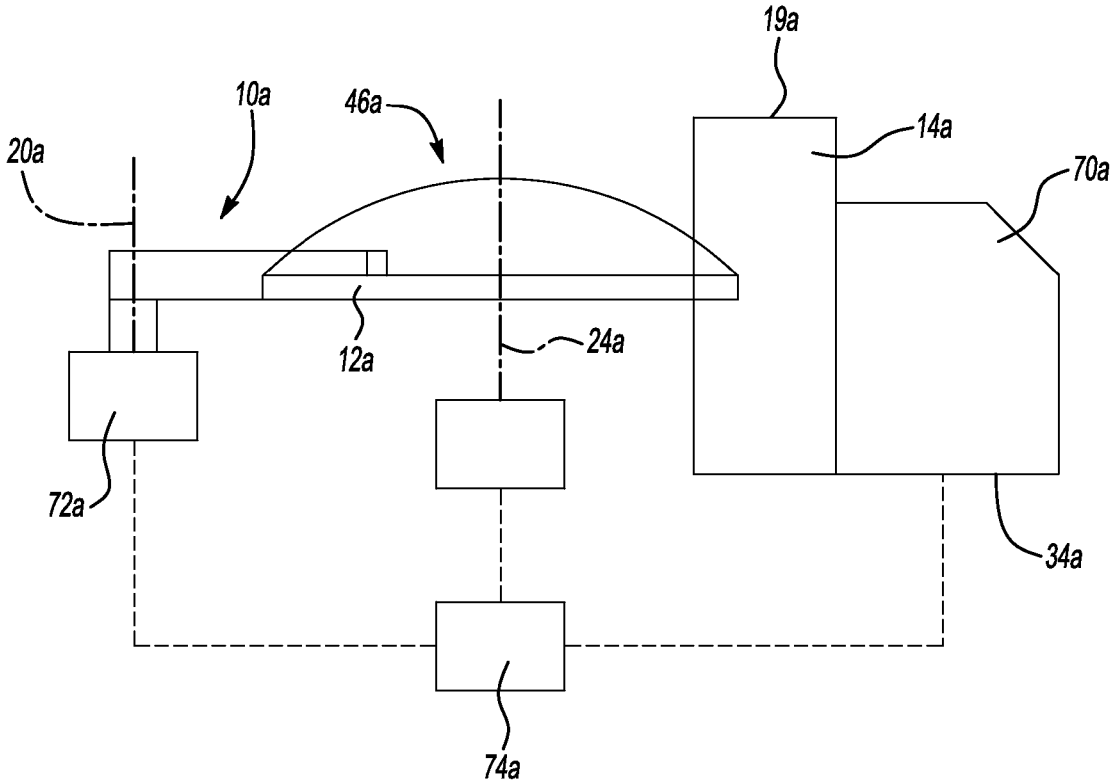
FIGS. 11A-11D are schematic views similar to FIG. 8 and represent alternative operating environments for practicing the invention.
Figure 11B:
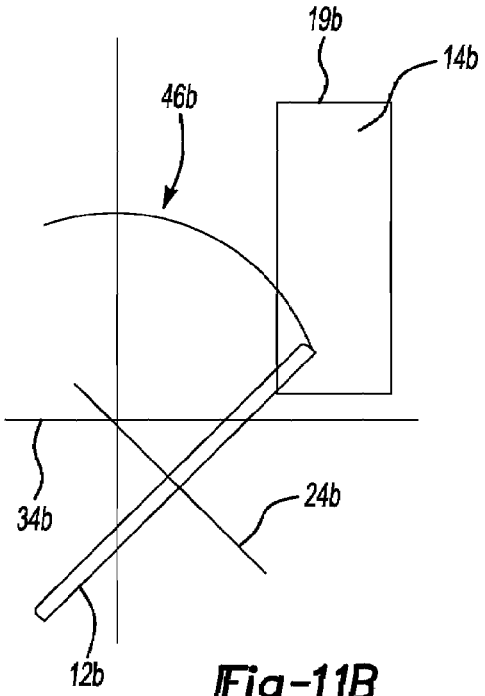
Figure 11C:
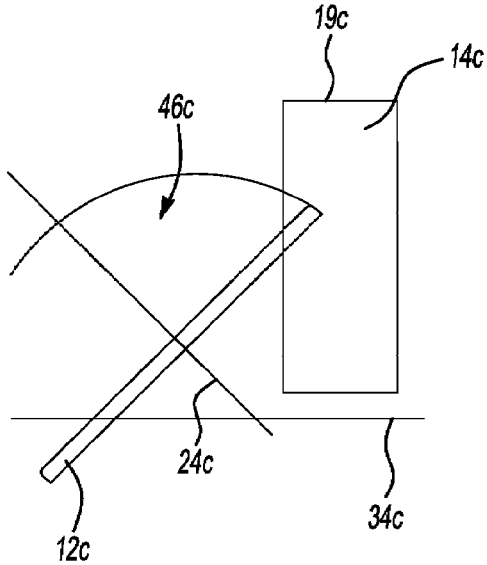
Figure 11D:
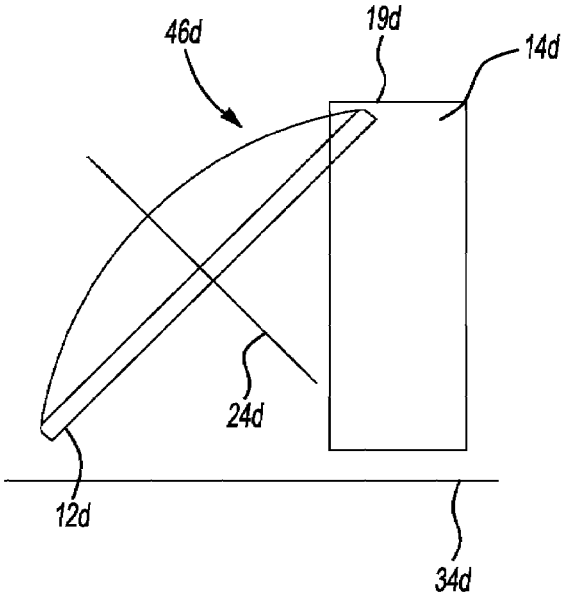

In an apparatus for practicing the invention, a fixture 70*a*, as shown schematically in FIG. 11A, can maintain the work-piece 14*a*. The fixture 70*a* may prevent movement of the work-piece 14*a* or may be operable to move the work-piece 14*a*. The grinding wheel 14*a* and the work-piece 14*a* can be rotated relative to one another while the grinding wheel 14*a* is contacting the work-piece 14*a* so that material is removed in a path that is at least partially circular. A moving device 72*a*, also shown schematically, can move the coolant nozzle 10*a* along first and second arcuate paths. A controller 74*a* can control the moving device 72*a* in accordance to the method set forth above. The controller 74*a* can be programmed with the geometry of the work-piece 14*a*, the grinding wheel 12*a*, and the coolant nozzle 10*a*, including the spatial relationships between these elements. The controller 74*a* can also be operable to control the rotation of the grinding wheel 14*a*, rectilinear movement of the grinding wheel axis 24*a*, and movement of the 70*a*.

Figure 18:
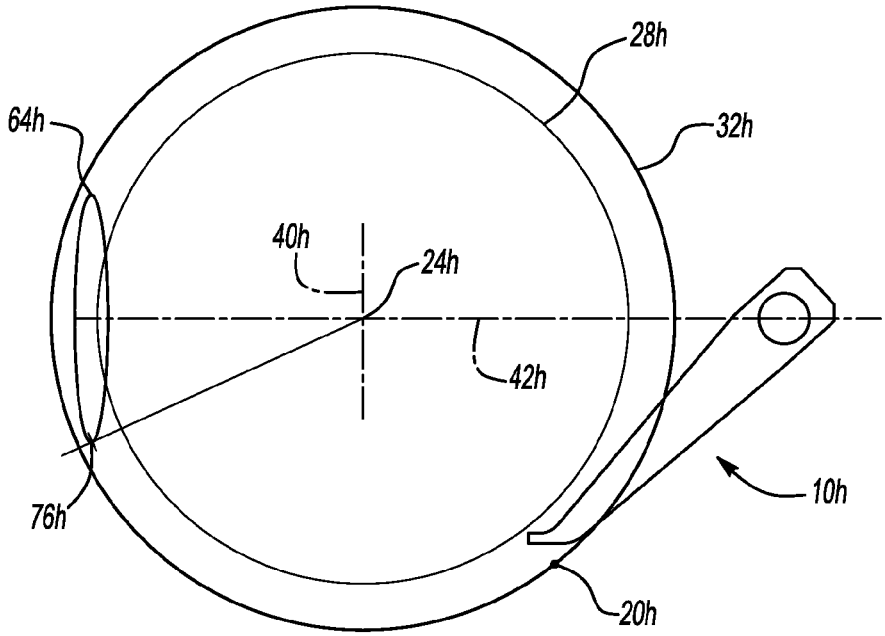
FIG. 18 is a planar view similar to FIGS. 1, 3 and 4 wherein the grinding wheel axis is normal to the plane of perspective and shows an ellipse corresponding to alternative operating environment for practicing the invention wherein the ellipse does not intersect the circle representing the path of movement of the coolant nozzle.
Figure 19:
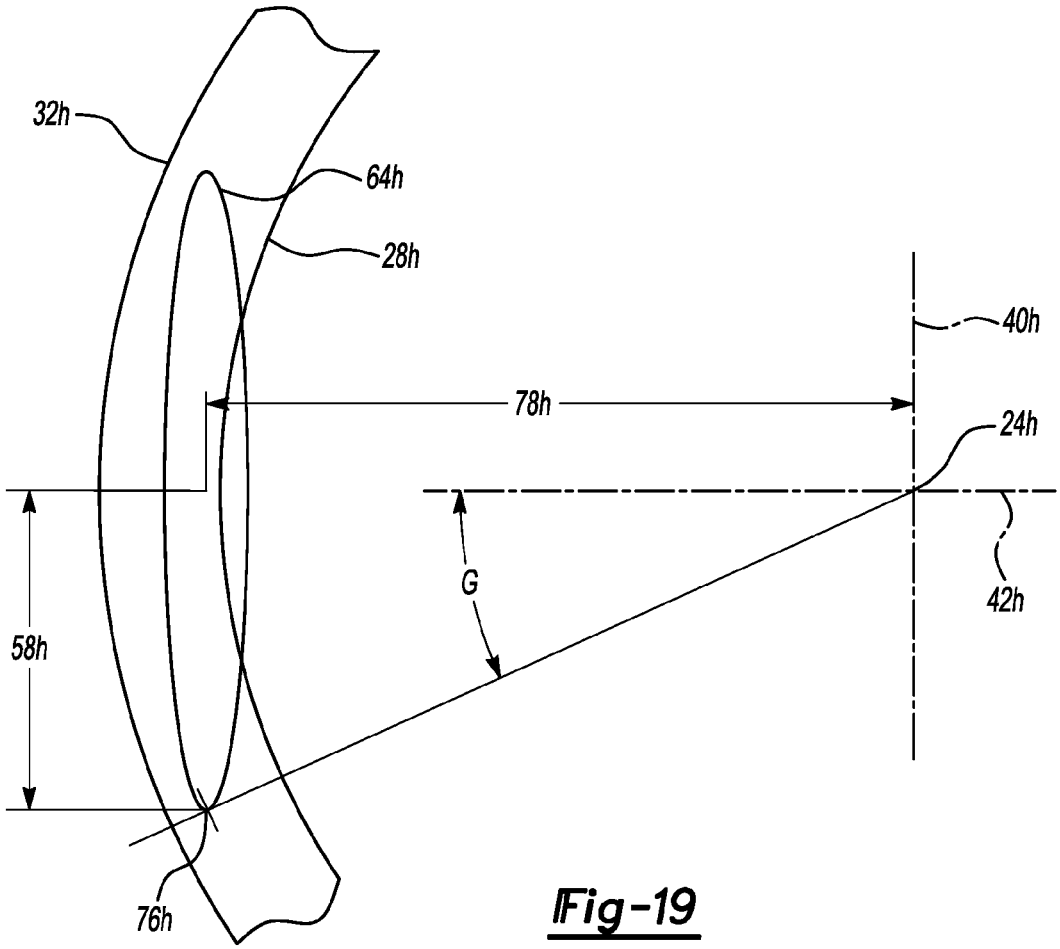
FIG. 19 is a magnified view of a portion of FIG. 18.

In some embodiments of the invention, the ellipse may not intersect the circle, as best shown in FIGS. 18 and 19. An arcuate path 32*h* is centered on a grinding wheel axis 24*h* of a grinding wheel having a diameter 28*h*. An end control point 20*h* of a coolant nozzle 10*h* moves along the path 32*h*. A third arcuate path 64*h* in the form of an ellipse represents the perimeter of a work-piece (not shown) that would first contact the end control point 20*h*, as that perimeter appears in the first plane. There is no intersection between the path 64*h* and the path 32*h*.

The controller of the apparatus can detect this condition. The maximum distance between any point on the ellipse 64*h* and the center axis 24*h* of the grinding wheel is compared with the radius of the circle 32*h*. The maximum distance on the ellipse 64*h* from the center axis 24*h* occurs at a "bottom point" 76*h*. When the maximum distance is less than the radius of the circle 32*h*, the controller can control the movement of the nozzle 10*h* to position the end control point 20*h* relative to the bottom point 76*h*.

FIG. 19 shows the bottom point 76*h* positioned a distance 78*h* from the grinding wheel axis 24*h* along an axis 42*h* and a distance 58*h* from the grinding wheel axis 24*h* along an axis 40*h*. The distance 78*h* is the same as the value for the letter "h" discussed above with respect to the first exemplary embodiment of the invention. Both distances 78*h* and 58*h* are known and so the inverse tangent function can be applied to determine an angle G. The end control point 20*h* can be moved to a position along the circle 32*h* that corresponds to the angle G plus any desired clearance, so that the nozzle 10*h* does not contact the work-piece.

The alternative embodiment of the method provided by the invention discussed immediately above can also be applied in operating environments where an intersection between the third arcuate path, such as an ellipse, and the second arcuate path, such as a circle, would occur on the far left side of the ellipse ("left" based on the perspective of FIGS. 18 and 19). If such an intersection point were relied upon to position the coolant nozzle, the nozzle could collide with some other part of the ellipse and thus collide with the work-piece.

An exemplary embodiment of the invention has been described in detail above. In the detailed exemplary embodiment, the work-piece 14 is rotated about the axis 34 as the grinding wheel 12 is removing material. However, grinding wheel 12 could be rotated about the axis 34 to perform a desired grinding operation in alternative embodiments of the invention. Also, neither the grinding wheel 12 nor the work-piece 14 may be rotated in alternative embodiments of the invention. For example, the work-piece could just be a static cylinder. Also, the invention can be applied in situations where there are holes or slots in the work-piece. If the work-piece includes bosses, the bosses would be incorporated into the definition of the body of the work-piece.

The method of the invention, as shown in the application of the exemplary embodiment, overcomes the problem of optimizing the nozzle position when the grinding wheel size is not known until run time due to a dressable grinding wheel being used. The method ensures that the cutting zone of the grinding wheel is cooled effectively. The method can be applied to continuous dress grinding where the grinding wheel is losing material throughout the grinding operation. These benefits are achieved by considering representations of the part and the nozzle in various planes so that the optimum position can be calculated within a controller at run time based on the actual size of the grinding wheel at any particular moment in time. It is noted that these benefits may not flow from every embodiment of the invention and that benefits other than those articulated herein may be enjoyed. Various, currently-available machines can be modified to practice the new invention, such as Makino models A99CD, A100CD and G5 I (see www.mackino.com).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method comprising the steps of:

disposing a coolant nozzle having a base and a distal end for movement relative to a grinding wheel and to a work-piece including movement of the distal end in a first plane normal to an axis of the grinding wheel along a first arcuate path centered on a pivot axis at the base and also movement of the pivot axis in the first plane along an orbit centered on the grinding wheel axis;

selecting a position of the distal end along the first arcuate path;

projecting a second arcuate path in the first plane centered on the grinding wheel axis and having a radius extending to the position of the distal end along the first arcuate path;

generating a third arcuate path in the first plane corresponding to a location of the work-piece that would be contacted first by the distal end during movement along the second arcuate path; and limiting movement of the distal end along the second arcuate path by an intersection between the second arcuate path and the third arcuate path.

2. The method of claim 1 further comprising the step of:

disposing the grinding wheel axis and a longitudinal axis of the work-piece transverse to one another.

3. The method of claim 1 wherein said generating step further comprises the step of:

converting the second arcuate path in the first plane into a first curve in a second plane containing the grinding wheel axis and a longitudinal axis of the work-piece.

4. The method of claim 3 wherein said generating step further comprises the step of:

projecting of an outer profile of the work-piece in the second plane with the first curve.

5. The method of claim 4 wherein said converting step further comprises the steps of:

extending a vector normal to the longitudinal axis and through three-dimensional space to a first point on the second arcuate path;

rotating the vector in three-dimensional space about the longitudinal axis and into the second plane; and generating a second point in the second plane at the end of the vector after said rotating step.

6. The method of claim 5 wherein said generating step further comprises the step of:

locating a third point in the second plane at which the first curve and the outer profile of the work-piece intersect one another; and projecting the third arcuate path in the first plane based on a location of the third point in the second plane.

7. The method of claim 6 wherein said step of projecting the third arcuate path in the first plane based on the location of the third point in the second plane is further defined as:

generating an ellipse in the first plane with an equation:

$$[(x-h)^2/e^2]+[(y-k)^2/f^2]=1$$

where f is equal to a minimum distance between the longitudinal axis of the work-piece and the third point in the second plane;

where k is equal to zero;

where e is equal to the sine function of an angle between the grinding wheel and the longitudinal axis multiplied by the value of f; and where h is equal to a radius of the grinding wheel less the value of e and less the distance of any radial offset between a radius of the grinding wheel and the third point.

8. The method of claim 7 wherein said step of limiting movement of the distal end along the second arcuate path includes the steps of:

concurrently solving the equation of the ellipse and an equation defining the second arcuate path for determining a fourth point at which the second arcuate path and the third arcuate path intersect one another.

9. The method of claim 4 wherein said generating step further comprises the steps of:

projecting a fourth arcuate path centered on the grinding wheel axis and disposed in a third plane parallel to and spaced from the first plane and having a radius equal to the radius of the second arcuate path;

converting the fourth arcuate path in the third plane into a second curve in the second plane;

extending a line in the second plane between the first curve and the second curve and parallel to the grinding wheel axis; and moving the line radially outward from the grinding wheel axis until substantially immediately prior to the line contacting the outer profile of the work-piece at a fifth point along the outer profile.

10. The method of claim 9 further comprising the step of:

generating an ellipse in the first plane based on a first distance in the second plane between the fifth point and the grinding wheel axis, a second distance in the second plane between the fifth point and the longitudinal axis, and an angle between the grinding wheel and the longitudinal axis.

11. The method of claim 4 wherein said generating step further comprises the steps of:

projecting a fourth arcuate path in the first plane concentric with said second arcuate path and centered on the grinding wheel axis and having a radius different than the radius of the second arcuate path;

converting the fourth arcuate path to a second curve in the second plane; and generating an ellipse in the first plane based on which of the first and second curves first contacts the profile of the work-piece in the second plane.

12. The method of claim 1 wherein said step of selecting the position for the distal end along the first arcuate path further comprises the steps of:

determining a first distance (b) between the grinding wheel axis and the pivot axis;

selecting a desired clearance distance between the distal end and the grinding wheel;

determining a second distance (a) by adding the desired clearance distance to a radius of the grinding wheel;

determining a third distance (c) between the distal end and the pivot axis; and selecting the position of the distal end along the first arcuate path as the position where the distal end is spaced an angle from an axis extending between the pivot axis and the grinding wheel axis, where the angle is equal to $\cos^{-1}((b^2+c^2-a^2)/2bc)$.

13. The method of claim 1 further comprising the steps of:

rotating the grinding wheel about the grinding wheel axis;

disposing the grinding wheel axis transverse to a longitudinal axis of the work-piece;

contacting the work-piece with the rotating grinding wheel to remove material from the work-piece;

rotating the grinding wheel and the work-piece relative to one another during said contacting step whereby material is removed along a path at least partially circular and extending about a longitudinal axis of the work-piece; and directing cooling fluid to the grinding wheel from the coolant nozzle during said contacting step.

14. The method of claim 13 wherein said step of selecting the position for the distal end along the first arcuate path includes the steps of:

selecting an initial position of the distal end along the first arcuate path; and changing the position of the distal end along the first arcuate path during said contacting step in response to a change in a diameter of the grinding wheel.

15. The method of claim 14 including the step of:

moving the distal end further along the second arcuate path in response to said changing step.

16. The method of claim 14 wherein said step of projecting the second arcuate path in the first plane includes the steps of:

projecting a first configuration for the second arcuate path in response to said step of selecting the initial position of the distal end along the first arcuate path; and projecting a second configuration different than said first configuration for the second arcuate path in response to said step of changing the position of the distal end along the first arcuate path.

17. The method of claim 13 wherein said step of projecting the second arcuate path is further defined as:

projecting a plurality of arcuate paths in the first plane centered on the grinding wheel axis and having different radii.

18. The method of claim 13 wherein said step of projecting the second arcuate path is further defined as:

projecting a plurality of arcuate paths each centered on the grinding wheel axis and having the same radius wherein the plurality of arcuate paths are disposed in different parallel planes.

19. The method of claim 13 wherein said generating step includes the step of:

converting the second arcuate path in the first plane to a curve in a second plane transverse to the first plane and containing the grinding wheel axis and the longitudinal axis of the work-piece to locate along the curve a point of intersection with the work-piece in the second plane; and converting the point of intersection located in the second plane into the third arcuate path in the first plane.

* * * * *